US007185461B2

(12) United States Patent
Lapointe et al.

(10) Patent No.: US 7,185,461 B2
(45) Date of Patent: Mar. 6, 2007

(54) ANCHORING MEMBER FOR A SUPPORT POST

(75) Inventors: Jean Lapointe, Laval (CA); Robert Griffith, Repentigny (CA)

(73) Assignee: Kalitec Signalisation Inc., Laval (CA)

( * ) Notice: Subject to any disclaimer, the term of this patent is extended or adjusted under 35 U.S.C. 154(b) by 484 days.

(21) Appl. No.: 09/820,834

(22) Filed: Mar. 30, 2001

(65) Prior Publication Data

US 2002/0139067 A1 Oct. 3, 2002

(51) Int. Cl.
*E04H 12/22* (2006.01)
*A45F 3/44* (2006.01)

(52) U.S. Cl. ..... 52/154; 52/165; 248/533; 403/297

(58) Field of Classification Search ..... 52/153, 52/154, 155, 165, 298, 726.3, 726.4; 248/511, 248/530, 533, 539; 403/292, 297
See application file for complete search history.

(56) References Cited

U.S. PATENT DOCUMENTS 973,887 A 10/1910 Steinmetz
996,316 A * 6/1911 Connors ..... 52/155
1,954,070 A 4/1934 Cook
2,775,221 A * 12/1956 Olson ..... 248/511
2,864,241 A 12/1958 Fiore et al.
2,947,149 A 8/1960 Barkley, Jr.
3,668,877 A 6/1972 Fuentes, Jr.
3,688,014 A 8/1972 Versteeg
4,084,814 A * 4/1978 Boggild ..... 248/511
4,520,985 A * 6/1985 Blumenthal ..... 248/530
4,799,340 A 1/1989 Lichau et al.
5,217,194 A * 6/1993 Brownell ..... 248/530
5,293,889 A * 3/1994 Hall et al. ..... 248/533
5,632,464 A * 5/1997 Aberle ..... 248/530
5,860,253 A * 1/1999 Lapointe ..... 52/98
5,984,587 A * 11/1999 Odle ..... 52/153
6,050,034 A * 4/2000 Krinner ..... 52/155

FOREIGN PATENT DOCUMENTS

CH 333104 10/1958

* cited by examiner

*Primary Examiner*—Michael Safavi
(74) *Attorney, Agent, or Firm*—Ogilvy Renault LLP

(57) ABSTRACT

A post footing for holding a post segment above a ground surface comprises an outer sleeve adapted to be forcibly driven into the ground. A socket member is pressure fitted within the outer sleeve with the leading end of the sleeve extending beyond the socket member to prevent the latter from being damaged in the event that an obstacle be encountered while the footing is being driven into the ground. The socket member defines a socket adapted to receive and hold an above-ground post segment once the footing has been installed in the ground.

20 Claims, 2 Drawing Sheets

ANCHORING MEMBER FOR A SUPPORT POST

BACKGROUND OF THE INVENTION

1. Field of the Invention

The present invention relates to post structures and, more particularly, to post footings.

2. Description of the Prior Art

It is known to provide a post with a weakened section that allows the post to bend upon impact according to a predetermined pattern. For instance, U.S. Pat. No. 5,860,253 issued on Jan. 19, 1999 to Lapointe discloses a collapsible post comprising an elongated post section adapted to be connected in an end-to-end relationship with an anchoring member or post shoe driven into the ground. The shoe is provided at an upper end thereof with a socket for receiving and retaining the lower end of a connecting member. Likewise, the upper end of the connecting member is received and held in a socket defined in the lower end of the elongated post section, thereby physically connecting the shoe to the post section.

One problem associated with this type of post construction is that when hammered driven into the ground, the shoe can be deformed, for instance, as a result of a collision with an obstacle. In certain instances, the deformation may be such as to interfere with the subsequent insertion of the connecting member into the shoe, thereby preventing the post section from being mounted onto the shoe. In such cases, the shoe has to be removed from the ground and replaced by a new one.

Therefore, there is a need for a new post anchoring footing.

SUMMARY OF THE INVENTION

It is therefore an aim of the present invention to provide a new post footing.

It is also an aim of the present invention to provide a new post footing having a connecting part which is protected against deformations resulting from the collision of the footing with an obstacle while being driven into a ground surface.

Therefore, in accordance with the present invention, there is provided a post comprising a footing adapted to be driven into the ground, said footing including an outer sleeve and a socket member, said outer sleeve having trailing and leading ends, said leading end being adapted to be forcibly driven into the ground in response to a driving force applied to said trailing end, said socket member being fixed within said outer sleeve with said leading end of said outer sleeve extending beyond said socket member to prevent the latter from being damaged in the event that an obstacle be encountered while said footing is being driven into the ground, an elongated post segment, and a connector inserted into said elongated post segment and said socket member for joining said post segment and said footing together in an end-to-end relationship.

In accordance with a further general aspect of the present invention, there is provided a footing for holding a post segment above a ground surface, comprising an outer sleeve having trailing and leading ends, said leading end being adapted to be forcibly driven into the ground in response to a driving force applied to said trailing end, and a socket member fixed within said outer sleeve with said leading end of said outer sleeve extending beyond said socket member to prevent the latter from being damaged in the event that an obstacle be encountered while said footing is being driven into the ground, wherein said socket member defines a socket adapted to receive a structural piece once said footing has been installed in the ground.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Now referring to FIG. 1, a post 10 suited for supporting signs 12 and 14 and embodying the elements of the present invention will be described. It is understood that even though the post 10 is herein described as being a signaling post, it could be used without signs 12 and 14 and in any suitable context without departing from the scope of the present invention.

The post 10 is anchored into a volume of suitable material herein referred to as ground 16. The ground 16 can, for instance, include a layer of asphalt, a layer of compressed crushed rocks or other layers of similar dense material. As will be described hereinbelow, a stabilizer 18 can even be used for allowing the post 10 to be anchored into soft ground surfaces.

Figure 1:
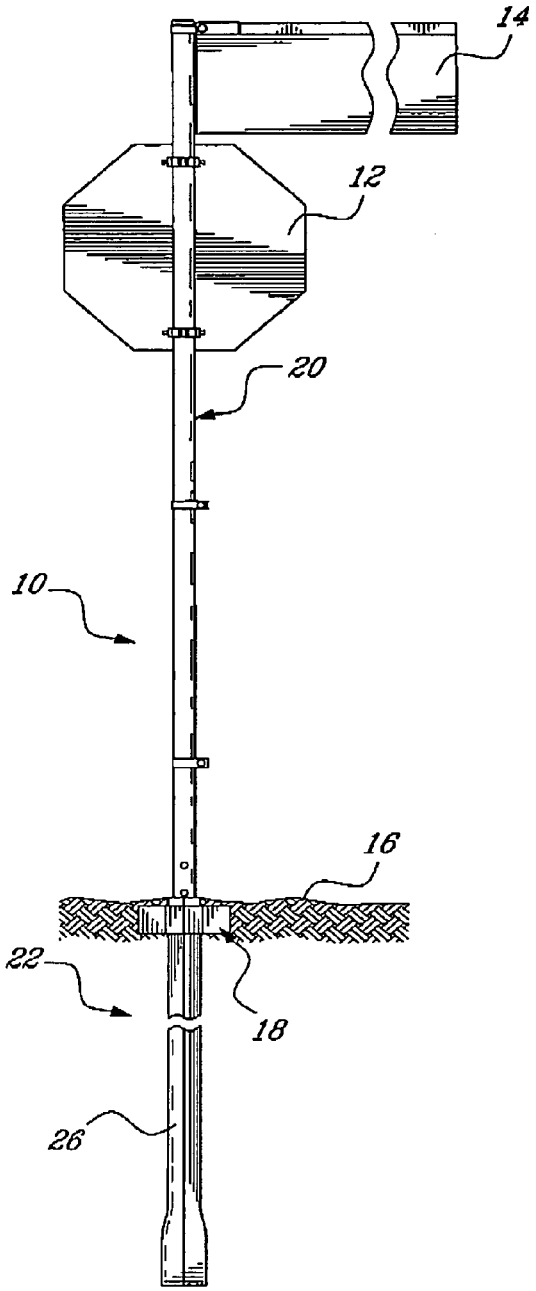
FIG. 1 is a vertical elevational view of a post structure having a footing in accordance with a first embodiment of the present invention.

The post 10 essentially includes an elongated tubular post segment 20 for supporting the signs 12 and 14 at a desired elevation above the ground 16, a footing 22 for anchoring the tubular post segment 20 in the ground 16, and a connector 24 for coupling the post segment 20 and the footing 22 in an abutting end-to-end relationship, as illustrated in FIG. 1.

Figure 2:
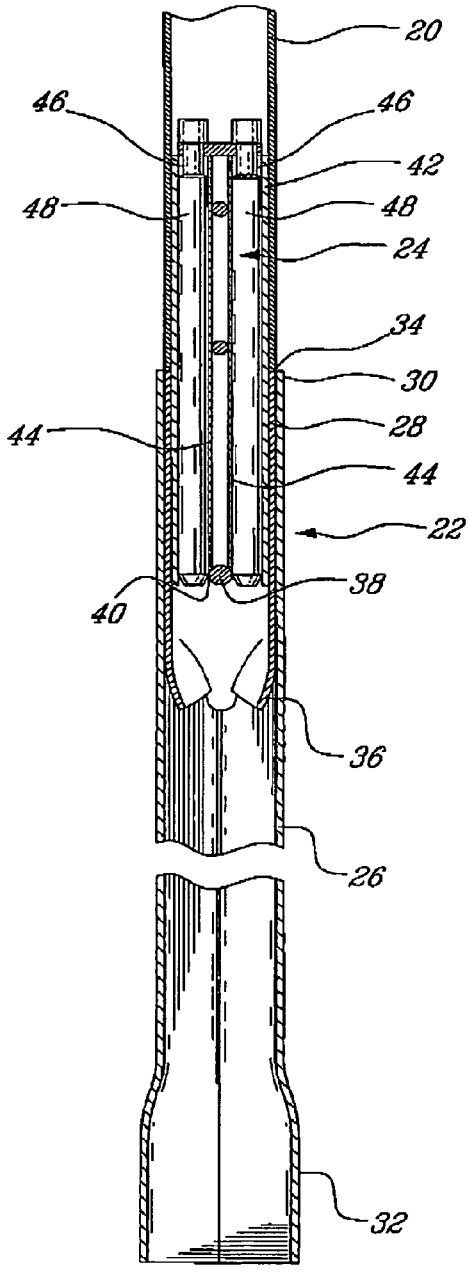
FIG. 2 is an enlarged vertical cross-sectional view illustrating some details of the footing.

As shown in FIG. 2, the footing 22 includes a protective sleeve 26 and a socket member 28 fixed within the protective sleeve 26 for subsequently receiving therein one end of the connector 24. The protective sleeve 26 has a square cross-section and is made of non-galvanized steel, whereas the socket member 28 has an elliptical cross-section and is made of galvanized steel. One reason of using a non-galvanized protective sleeve 26 is that while in contact with the surrounding ground material, the sleeve 26 will gradually becomes rusty, which will have the effect of stiffening the sleeve 26 in the ground 16. It is noted that an acrylic primer can be applied on the protective sleeve 26.

Figure 3:
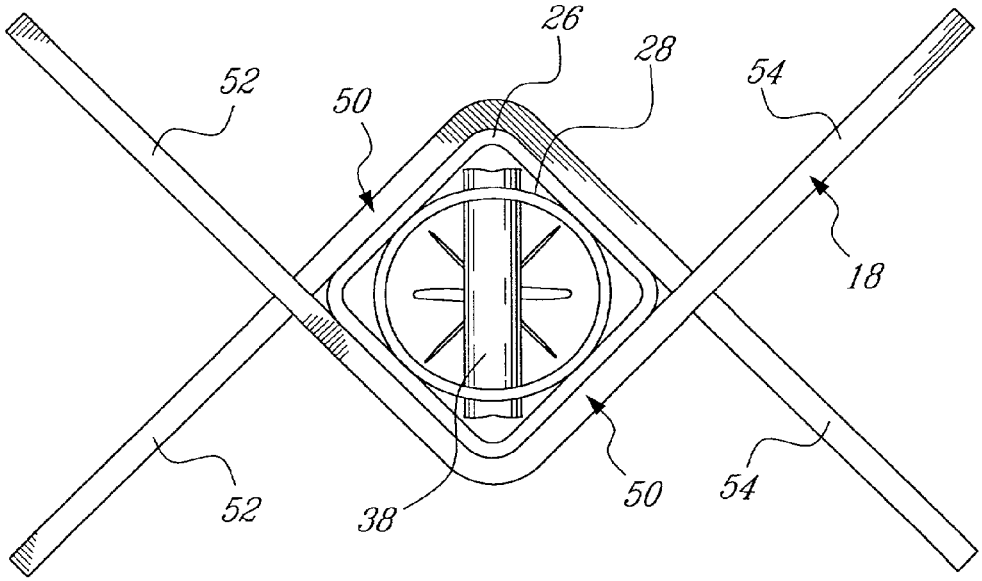
FIG. 3 is a top plan view of the footing with a stabilizer installed thereon.

The socket member 28 is preferably pressure fitted within the sleeve 26 with the major axis of the ellipse defined by the socket member 28 passing through a pair of diagonally opposed corners of the sleeve 26, as illustrated in FIG. 3. The elliptical cross-section of the socket member 28 provides for easy angular alignment of the connecting portions of the post segment 20, the connector 24 and the socket member 28.

The sleeve 26 and the socket member 28 have respective trailing and leading ends 30, 32, 34 and 36. As can be seen from FIG. 2, the leading end 32 of the protective sleeve 26 extends beyond the leading end 36 of the socket member 28. This affords protection to the socket member 28 in that in the event that an obstacle is encountered while driving the footing 22 in the ground 16, the shock will be absorbed by the protective sleeve 26, thereby preventing the socket member 28 from being deformed. This constitutes a major advantage in that it ensures the integrity of the socket member 28 while being driven into the ground 16 and thus prevent the same from being deformed, which could interfere with the subsequent insertion of the connector 24 into the socket member 28 and, thus, potentially prevent the on-site assembly of the post 10.

As shown in FIG. 2, the leading end 32 of the protective sleeve 26 is preferably flatten so as to form a transversal cutting blade in order to facilitate the penetration of the footing 22 in the ground 16. The pressing of the leading end 32 of the sleeve 26 can be performed after the socket member 28 has been pressure fitted into the sleeve 26.

The socket member 28 is preferably inserted down into the sleeve 26 to a depth where the trailing ends 30 and 34 of the sleeve 26 and the socket member 28 are flush, i.e. at a same level.

In the placement of the above-described footing 22, one uses a post driver, such as a pneumatic hammer. To place the footing 22, a penetration point is first set and then successive power hammer blows are applied to the trailing end 30 of the sleeve 26 to cause the same with the socket member 28 to be vertically driven down into the ground 16 to a desired depth of insertion. It is noted that in the event that the post 10 has to be installed in a concrete surface, it might be necessary to first drill a pilot hole. However, in most instances, it is not necessary to drill a pilot hole to drive the footing 22 into the ground.

As can be seen from FIG. 2, the socket member 28 is provided with an internal abutment rod 38 extending transversally therethrough. Once the footing 22 has been driven into the ground 16, the connector 24 is inserted into the socket member 28 and lowered onto the abutment rod 38. As seen in FIG. 2, the abutment rod 38 is received in a recess 40 defined at the leading end of the connector 24.

The connector 24 is of the type described in U.S. Pat. No. 5,860,253 issued on Jan. 19, 1999, and includes an elongated elliptical body 42 defining a pair of jaws 44, each of which defines an axially extending channel 46 for receiving a corresponding nail 48. To secure the connector 24 to the socket member 28, the nails 48 are forced longitudinally into the channels 46 and over the abutment rod 38. As the nails 48 pass over the rod 38, they are diverted laterally outwardly, thereby causing the connector 24 to flare radially outwardly. This radial expansion of the connector 24 causes the same to frictionally engage the surrounding inner surface of the socket member 28, thereby securing the connector 24 to the socket member 28.

Thereafter, the tubular post segment 20 is fitted over the connector 24 in abutment with the socket member 28 and bolted in place.

The footing 22 being solidly anchored into the ground 16, the post 10 will have a tendency to bend about its most frangible section. Since the footing 22 and the post segment 20 are both made of a stronger material that the connector 24, and since the footing 22 and the post segment 20 both have a greater diameter than the connector 24, a lateral impact on the post 10 will cause the latter to bend or shear about the connector 24.

Figure 4:
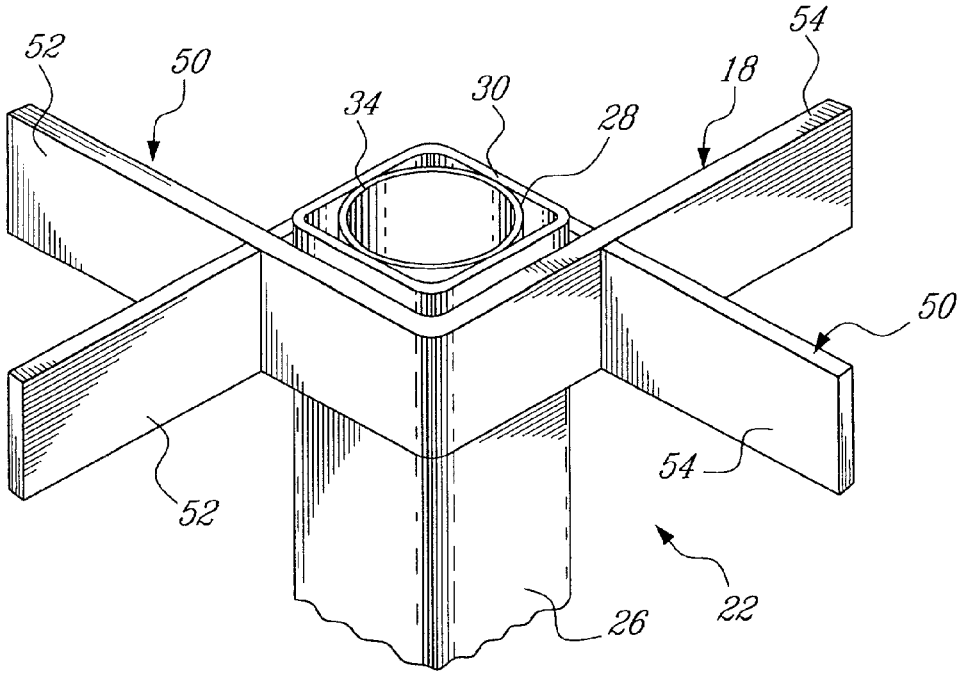
FIG. 4 is perspective view of the upper end of the footing with the stabilizer installed thereon.

As shown in FIG. 4, the stabilizer 18 includes a pair of steel strips 50. Each strip 50 has a first arm segment 52 and a second arm segment 54 extending at right angles from one end of the first segment 52. A slot (not shown) is defined in each arm segment 52/54 for allowing the strips 50 to be inserted one into the other about the protective sleeve 26. Once assembled about the sleeve 26, the stabilizer 18 forms first and second pairs of diverging stabilizing arms on opposed sides of the sleeve 26. The slots are positioned so that when the strips 50 are assembled together, the so formed stabilizer tightly grasps the sleeve 26.

In use, the footing 22 is partly driven into the ground 16 and then the strips are assembled about the sleeve 26. Thereafter, the footing 22 is fully driven into the ground 16 so that the stabilizer 18 be buried in the surrounding ground material. It is noted that a number of stabilizers can be installed along the sleeve 26. Spacers (not shown) can be provided between the stabilizers to maintain the axial spacing between adjacent stabilizers.

In accordance with a further embodiment of the present invention, an above-ground post segment could be directly inserted into a socket member fixed within a protective sleeve without the use of a intermediate piece, such as connector 24. In this case, a wedge could be used to secure the socket member within the protective sleeve.

The invention claimed is:

1. A post comprising an inground footing, said inground footing including a socket member that is protected against deformation while being implanted into the ground by an outer sleeve, said socket member being substantially fully inserted into said outer sleeve, said outer sleeve having trailing and leading ends, said leading end being adapted to be forcibly driven into the ground in response to a driving face applied to said trailing end, said socket member being received within said outer sleeve with said leading end of said outer sleeve extending beyond said socket member so as to define a free space extending axially below said socket member for absorbing the shock in the event that an obstacle is encountered while said footing is being driven into the ground, thereby preventing the socket member from being damaged, an elongated post segment, and a connector axially inserted into said elongated post segment and said socket member for joining said post segment and said footing together in an end-to-end relationship, said connector having a lower end portion received into said socket member in said outer sleeve and an upper end portion extending axially above the socket member into the elongated post segment.

2. A post as defined in claim 1, wherein said socket member is pressure fitted within said outer sleeve.

3. A post as defined in claim 2, wherein said socket member is fully inserted within said outer sleeve with an upper end of said socket member leveled with said trailing end of said outer sleeve.

4. A post as defined in claim 1, wherein said outer sleeve is made of a non-galvanized material, whereas said socket member is made of a galvanized material.

5. A post as defined in claim 1, wherein said leading end of said outer sleeve is flattened to facilitate the penetration thereof into the ground.

6. A post as defined in claim 1, wherein said outer sleeve and said socket member have respectively a square cross-section and an elliptical cross-section.

7. A post as defined in claim 1, further including at least one stabilizer removably fined over said outer sleeve to provide lateral stability to said post.

8. A post as defined in claim 7, wherein said stabilizer includes a pair of strips having slots defined therein for allowing said strips to be inserted one into the other about said outer sleeve.

9. A post as defined in claim 8, wherein each said strip includes a first elongated segment and a second elongated segment extending at right angles from one end of said first segment, said strips being assembled together to form a pair of diverging arms on opposed sides of said sleeve.

10. A footing for holding a post segment above a ground surface, comprising a socket member that is protected against deformation while being implanted into the ground by an outer sleeve, said socket member being substantially fully inserted into said outer sleeve, said outer sleeve having trailing and leading ends, wherein said trailing end is directly accessible for receiving blows thereon in order to forcibly drive said leading end into the ground, said socket member being held within said outer sleeve with said leading end of said outer sleeve extending beyond said socket member so as to define a free space extending axially below said socket member for absorbing the shock in the event that an obstacle is encountered while said footing is being driven into the ground, thereby protecting the socket member against deformation, and a connector having a lower end portion received into said socket member in said outer sleeve and an upper end extending axially outwardly from said socket member, said upper end of said connector being configured to fit within the post segment to be anchored in the ground, wherein said outer sleeve is made of non-galvanized material, whereas said socket member is made of a galvanized material.

11. A footing as defined in claim 10, wherein said socket member is pressure fitted within said outer sleeve.

12. A footing as defined in claim 11, wherein said socket member is fully inserted within said outer sleeve with an upper end of said socket member leveled with said trailing end of said outer sleeve.

13. A footing as defined in claim 10, wherein said leading end of said outer sleeve is flattened to facilitate the penetration thereof into the ground.

14. A footing as defined in claim 10, wherein said outer sleeve and said socket member have respectively a square cross-section and an elliptical cross-section.

15. A footing as defined in claim 10, further including at least one stabilizer removably fitted over said outer sleeve to provide lateral stability.

16. A footing as defined in claim 15, wherein said stabilizer includes a pair of strips having slots defined therein for allowing said strips to be inserted one into the other about said outer sleeve.

17. A post as defined in claim 16, wherein each said strip includes a first elongated segment and a second elongated segment extending at right angles from one end of said first segment, said strips being assembled together to form a pair of diverging arms on opposed sides of said sleeve.

18. A post comprising a footing adapted to be driven into the ground, said footing including a socket member that is protected against deformation while being implanted into the ground by an outer sleeve, said outer sleeve having trailing and leading ends, said leading end being adapted to be forcibly driven into the ground in response to a driving force applied to said trailing end, said socket member being received within said outer sleeve with said leading end of said outer sleeve extending beyond said socket member to absorb the shock and thereby protect the socket member in the event that an obstacle is encountered while said fooling is being driven into the ground, an elongated post segment, and a connector axially inserted into said elongated post segment and said socket member for joining said post segment and said footing together in an end-to-end relationship, further including at least one stabilizer removably fitted over said outer sleeve to provide lateral stability to said post, wherein said stabilizer includes a pair of strips having slots defined therein for allowing said strips to be inserted one into the other about said outer sleeve.

19. A post as defined in claim 18, wherein each said strip includes a first elongated segment and a second elongated segment extending it right angles from one end of said first segment, said strips being assembled together to form a pair of diverging arms on opposed sides of said sleeve.

20. A footing for holding a post segment above a ground surface, comprising a socket member that is protected against deformation while being implanted into the ground by an outer sleeve, said socket member being substantially fully inserted into said outer sleeve, said outer sleeve having trailing and leading ends, wherein said trailing end is directly accessible for receiving blows thereon in order to forcibly drive said leading end into the ground, said socket member being held within said outer sleeve with said leading end of said outer sleeve extending beyond said socket member so as to define a free space extending axially below said socket member for absorbing the shock in the event that an obstacle is encountered while said footing is being driven into the ground, thereby protecting the socket member against deformation, and a connector having a lower end portion received into said socket member in said outer sleeve and an upper end extending axially outwardly from said socket member, said upper end of said connector being configured to fit within the post segment to be anchored in the ground, wherein said outer sleeve and said socket member have respectively a square cross-section and an elliptical cross-section.

* * * * *